US007170464B2

(12) United States Patent
Tang et al.

(10) Patent No.: US 7,170,464 B2
(45) Date of Patent: Jan. 30, 2007

(54) INTEGRATED MOBILE COMMUNICATION ANTENNA

(75) Inventors: Chia-Lun Tang, Miaoli Country (TW); Shih-Huang Yeh, Yunlin Country (TW); Kin-Lu Wong, Kaohsiung (TW); Shao-Lun Chien, Taoyuan Country (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/989,507

(22) Filed: Nov. 17, 2004

(65) Prior Publication Data

US 2006/0071865 A1 Apr. 6, 2006

(30) Foreign Application Priority Data

Sep. 21, 2004 (TW) ..... 93128636 A

(51) Int. Cl.
*H01Q 1/22* (2006.01)

(52) U.S. Cl. ..... 343/830; 343/841; 343/846

(58) Field of Classification Search ..... 343/700 MS, 343/713, 829, 830, 846, 841
See application file for complete search history.

(56) References Cited

U.S. PATENT DOCUMENTS 3,656,160 A * 4/1972 Burton ..... 343/702
4,924,237 A * 5/1990 Honda et al. ..... 343/702
6,308,084 B1 10/2001 Lonka
6,417,817 B1 * 7/2002 Pirila et al. ..... 343/841
6,614,400 B2 9/2003 Egorov
6,717,548 B2 4/2004 Chen
2003/0125079 A1 7/2003 Park et al.
2004/0097262 A1 5/2004 Lee

* cited by examiner

*Primary Examiner*—Michael C. Wimer
(74) *Attorney, Agent, or Firm*—Birch, Stewart, Kolasch & Birch, LLP

(57) ABSTRACT

An integrated antenna for mobile communications. A short-circuiting metal cylinder is provided in the antenna for arranging other functional modules such that the antenna and related circuits may have better integration. The provided antenna includes a ground with a via-hole; a radiating member arranged on the ground and having a feeding portion for receiving signals via electrical connection through the via-hole; and a short-circuiting member having a space, a first end of which is electrically connected to the ground substantially vertically, and the other end of which is electrically connected to the radiating member. The radiating member further includes a first sub-radiating member, a second sub-radiating member and a third sub-radiating member. The first sub-radiating member is substantially triangular, and the second sub-radiating portion is substantially parallel to the ground. The third sub-radiating member is substantially parallel to the first sub-radiating member.

12 Claims, 9 Drawing Sheets

INTEGRATED MOBILE COMMUNICATION ANTENNA

FIELD OF THE INVENTION

The invention relates to a mobile communication antenna, and particularly to a mobile communication antenna that integrates other functional modules and meets multiband operation requirements of mobile communication devices.

BACKGROUND OF THE INVENTION

With increasing popularity of mobile communication devices and fierce competition in the market place, manufacturers are constantly adding more functions to mobile communication devices to enhance product competitiveness. For instance, adding built-in digital cameras to mobile phones has become very fashionable in recent years.

As lean profile and light weight have become basic conditions of development for mobile communication devices, how to integrate the antenna and other functional modules in the limited space inside the mobile communication device and still meet the multiband operation requirements is an important issue that all mobile communication device makers now encounter. Take the highly popular mobile phone equipped with digital camera as an example, the internal antenna or digital camera functional modules are mostly located in the upper portion of the back side of the mobile phone. They have a high degree of overlapping. However, the known conventional techniques for the antenna and mobile communication devices, such as U.S. Pat. Nos. 6,614,400 and 6,717,548 concerning the antenna for mobile phone multiband operation, do not have a structural design for integrating the functional modules of the digital camera or other functional modules. U.S. patent application Nos. US2003/0125079 and US2004/0097262 disclose digital camera functional modules used on mobile phones that also adopt independent design and are installed in a specific location. They also do not offer an integrated design with the antenna. All this indicates that even in the highly competitive mobile phone market, a technique for integrating the antenna and functional modules is still not available.

As the antenna and other functional modules are usually designed independently and located separately, they result in a great waste of the limited space in the mobile communication device. Moreover, if they are located close to each other, electromagnetic interference occurs between the antenna and other functional modules, and the quality of the entire mobile communication device is affected.

Therefore how to integrate the antenna required in the mobile communication device and other function modules to meet the multiband operation requirements of the future mobile communication devices, and also enable other functional modules to function normally within the compact size of the mobile communication devices, are goals actively pursued in the industry.

SUMMARY OF THE INVENTION

In view of the aforesaid concerns, the primary object of the invention is to provide an integrated mobile communication antenna that has a short-circuiting metal cylinder to integrate the antenna and other functional modules of a mobile communication device so that the total size of the mobile communication device may be reduced.

Another object of the invention is to reduce electromagnetic interference between the antenna and other integrated functional modules and improve the service quality of the mobile communication device by grounding the metal cylinder.

Yet another object of the invention is to provide an antenna design with desired impedance matching to cover the operation bandwidth required for 3G mobile communication and wireless local area network to meet the requirements of multiband operation.

The integrated mobile communication antenna according to the invention mainly includes:

(a) a ground which has a via-hole (b) a radiating member located above the ground having a feeding portion to receive signals via electric connection through the via-hole. The radiating member includes a first sub-radiating member formed substantially in a triangle having a top point and a bottom edge opposing the top point where the feeding portion is located; a second sub-radiating member substantially parallel to the ground having a first edge and a second edge opposing each other, the first edge being electrically connected to the bottom edge; and a third sub-radiating member substantially parallel to the first sub-radiating member having a third edge connecting electrically to the second edge; and (c) a short-circuiting member having a space and a first end substantially vertical to the ground, electrically connecting to the ground, and a second end connecting electrically to the radiating member.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1A:
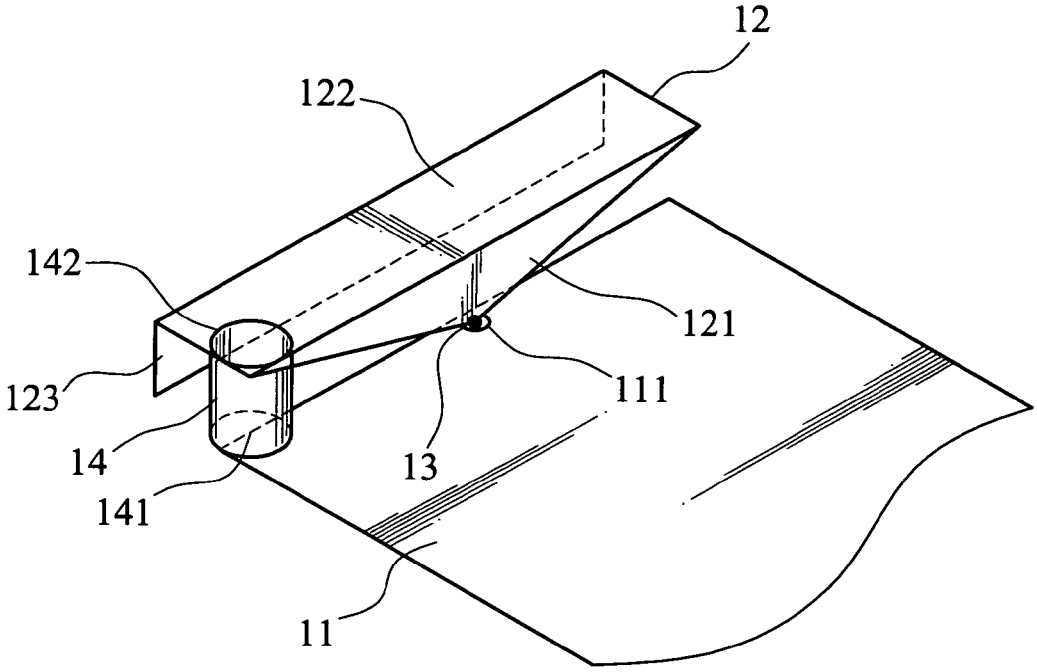
FIG. 1A is a perspective view of a first embodiment of the invention.
Figure 1B:
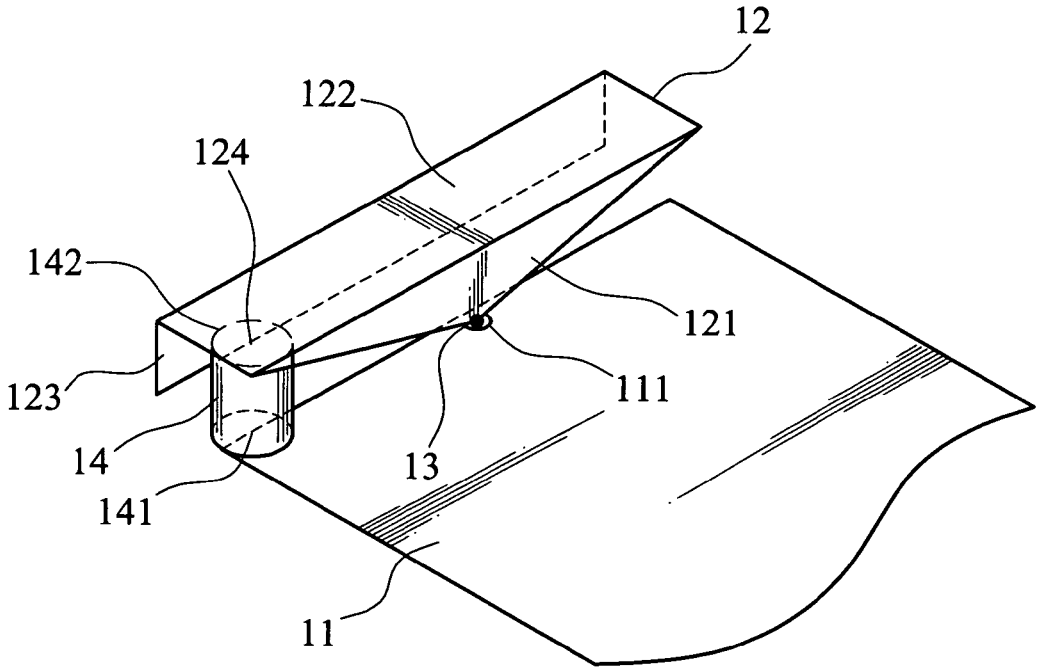
FIG. 1B is a perspective view of a second embodiment of the invention.

Refer to FIGS. 1A and 1B for a first embodiment and a second embodiment of the invention.

The structures of the antenna are substantially the same. The main elements are depicted as follows:

(a) A ground 11 has a via-hole 111 to allow an external signal source (not shown in the drawings) to pass through. It is formed substantially rectangular but may be adjusted according to the interior space of the mobile communication device where it is housed. Forming of the ground shape is a technique known in the art, so details are omitted here.

(b) A radiating member 12 is located above the ground 11 and has a feeding portion 13 to receive signals from the external signal source via electrical connection and through the via-hole 111. The feeding portion 13 may also be electrically connected to a feeding member (not shown in the drawings) to receive signals from the external signal source through the via-hole 111.

The radiation member 12 (refer to FIG. 2A for the flattened view thereof) includes:

(1) a first sub-radiating member 121 formed substantially triangular having a top point 13' and a bottom edge opposing the top point 13'. The top point 13' serves as the feeding portion 13 for receiving the external signals to activate the entire radiating member 12;

The reason for forming the first sub-radiating member 121 as a triangle is to provide a smooth area on the antenna surface to allow electrical current to be distributed more evenly, and to enable the antenna to have a better impedance matching.

(2) a second sub-radiating member 122 being substantially parallel to the ground 11 and having a first edge and a second edge opposing each other; the first edge being electrically connected to the bottom edge of the first sub-radiating member 121; and (3) a third sub-radiating member 123 being substantially parallel to the first sub-radiating member 121 and having a third edge connecting electrically to the second edge of the second sub-radiating member 122.

The entire radiating member 12 is formed by bending one piece of sheet metal to form the first sub-radiating member 121, second sub-radiating member 122 and third sub-radiating member 123. It also may be formed by coupling two or more separated metal sheets to form the first sub-radiating member 121, second sub-radiating member 122 and third sub-radiating member 123.

Moreover, the first sub-radiating member 121, second sub-radiating member 122 and third sub-radiating member 123, besides being formed by bending vertically relative to one another, may also be bent in an arched form and connected electrically. The actual coupling may be adjusted according to requirements.

The short-circuiting member 14 is the main feature of the invention to integrate with other functional modules (such as digital camera functional modules, not shown in the drawings). it is a short-circuiting metal cylinder having a space and a first end substantially vertical to the ground 11 and electrically connected to the ground 11, and a second end electrically connected to the radiating member 12.

In practice, the position of the ground member 14 may be adjusted according to the required impedance matching result. Details are omitted here.

Figure 2A:
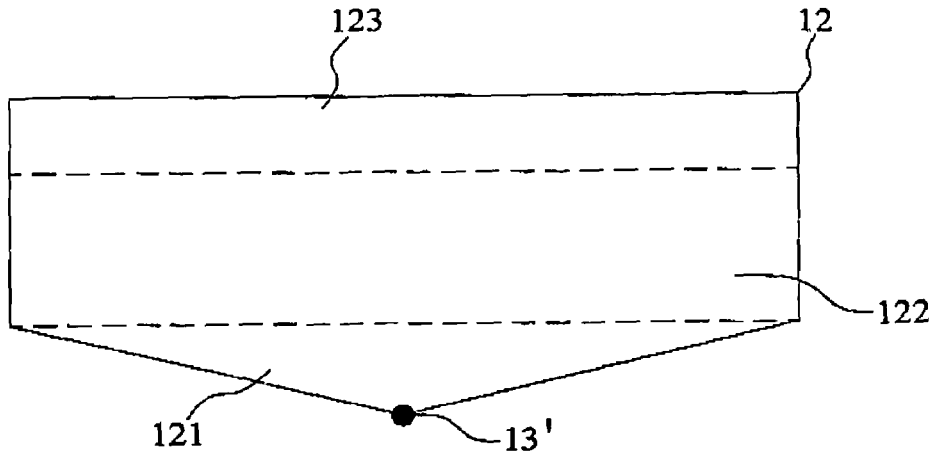
FIG. 2A is a plane view of a first embodiment of the radiating member of the invention in a flattened condition.
Figure 2B:
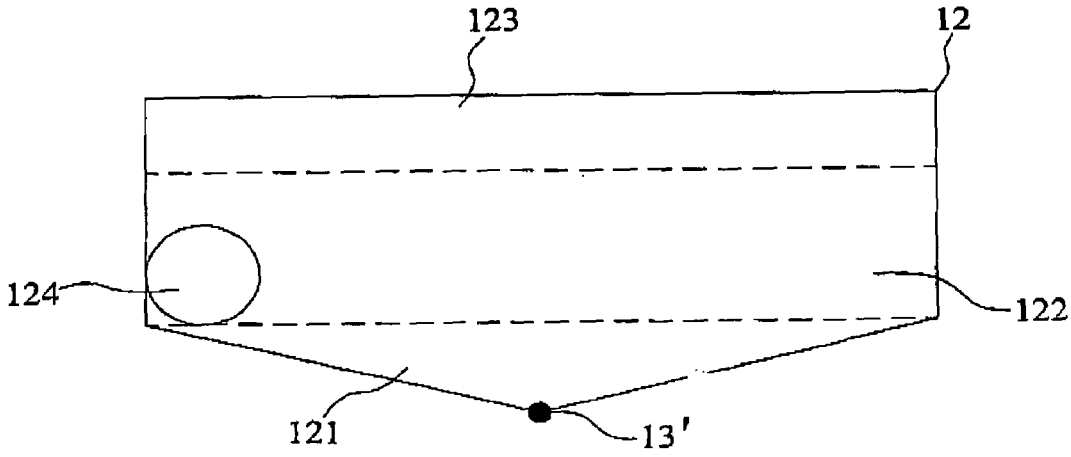
FIG. 2B is a plane view of a second embodiment of the radiating member of the invention in a flattened condition.

In addition, the short-circuiting member 14 may have two different embodiments according to the housing functional modules, and the antenna of the invention may also have two different embodiments as shown in FIGS. 1A and 1B. The radiating member 12 also has two different embodiments as shown in FIGS. 2A and 2B for matching.

The two embodiments of the short-circuiting member 14 differ in their designs for opening. For housing a general hidden functional module, only a lower opening 141 is formed on a first end of the short-circuiting member 14 connected to the ground 11 to facilitate connection of related circuits with the mobile communication device. The first embodiment is shown in FIGS. 1A and 2A.

For housing an exposed functional module (such as the digital camera functional module), in addition to the lower opening 141 on the short-circuiting member 14, the second end of the short-circuiting member 14 connected to the radiating member 12 also has an upper opening 142 to expose the functional module. This is the second embodiment shown in FIGS. 1B and 2B. The radiating member 12 has an opening 124 corresponding to the upper opening 142 with substantially the same size and shape so that the functional module may be fully exposed.

Figure 9A:
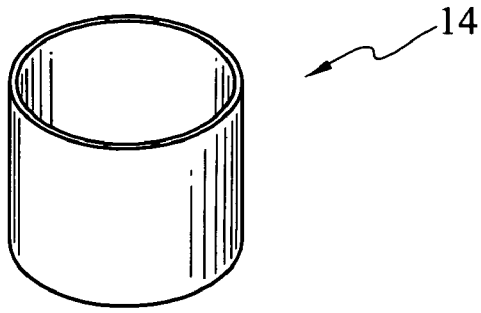
FIGS. 9A, 9B and 9C are schematic views of various embodiments of the short-circuiting member of the invention.
Figure 9B:
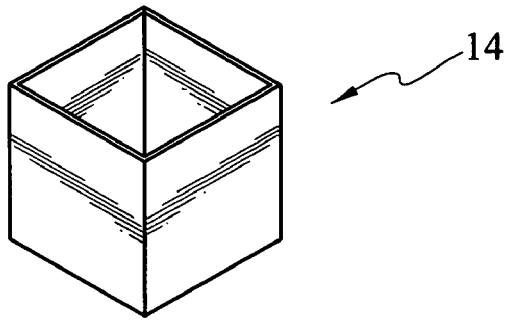
Figure 9C:
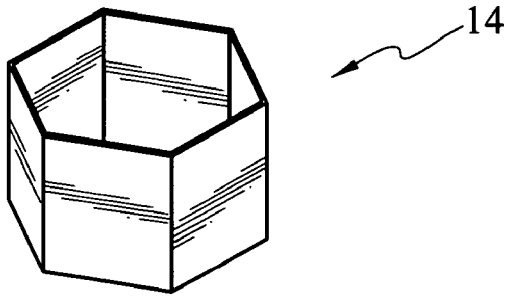

The short-circuiting member 14 may be formed as desired without restriction. It is generally circular, elliptical (as shown in FIG. 9A), rectangular (as shown in FIG. 9B), or polygonal (as shown in FIG. 9C).

Figure 3:
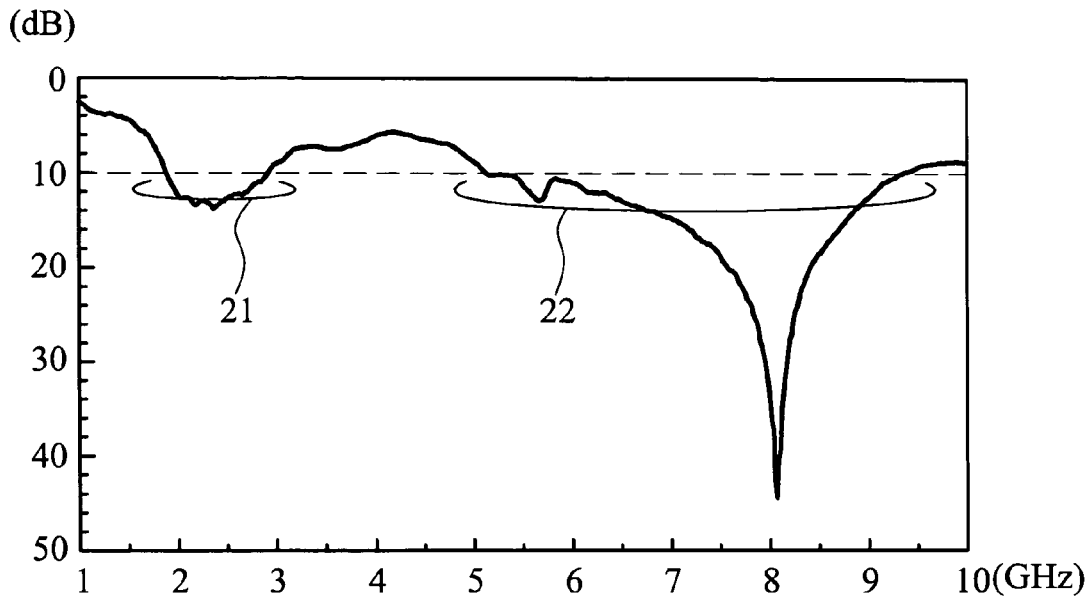
FIG. 3 is a chart showing the measured return loss according to the invention.
Figure 4A:
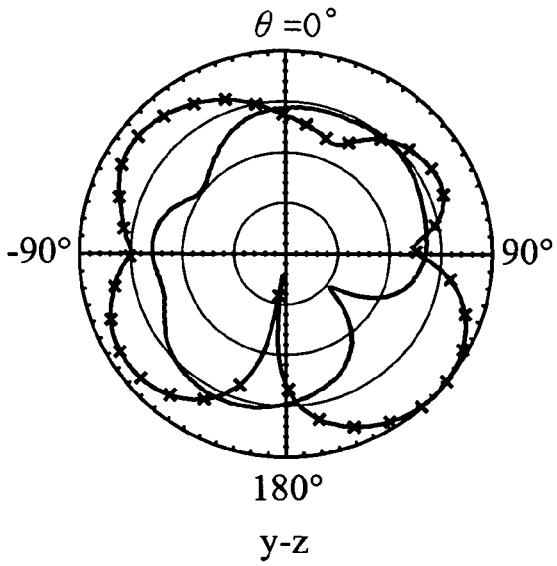
FIG. 4A~4C is a measured result of the radiation patterns at 2045 MHz.
Figure 4B:
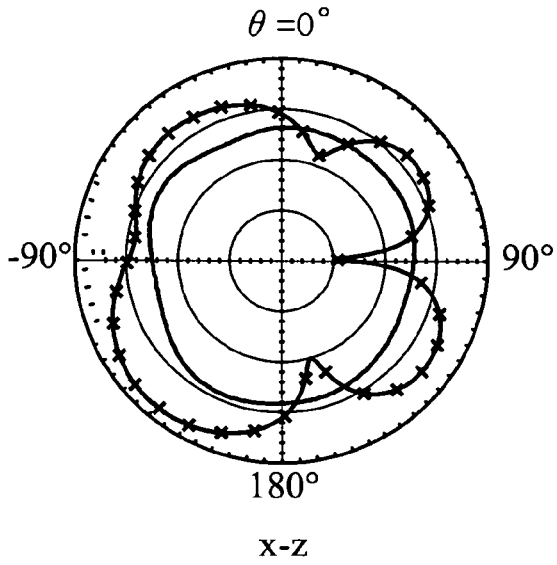
Figure 4C:
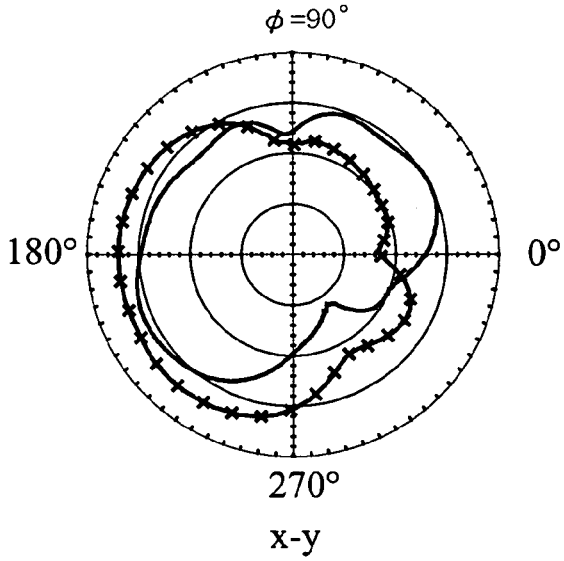
Figure 5A:
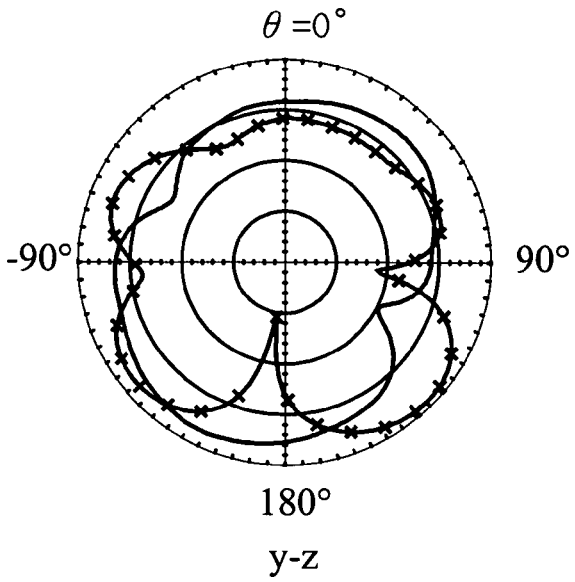
FIG. 5A~5C is a measured result of the radiation patterns at 2442 MHz.
Figure 5B:
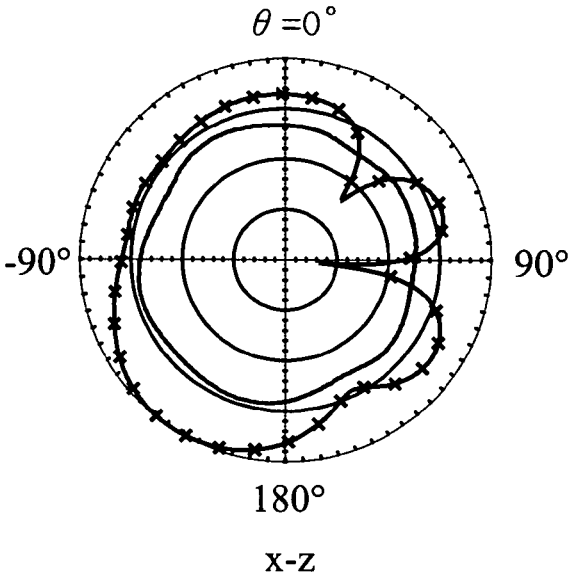
Figure 5C:
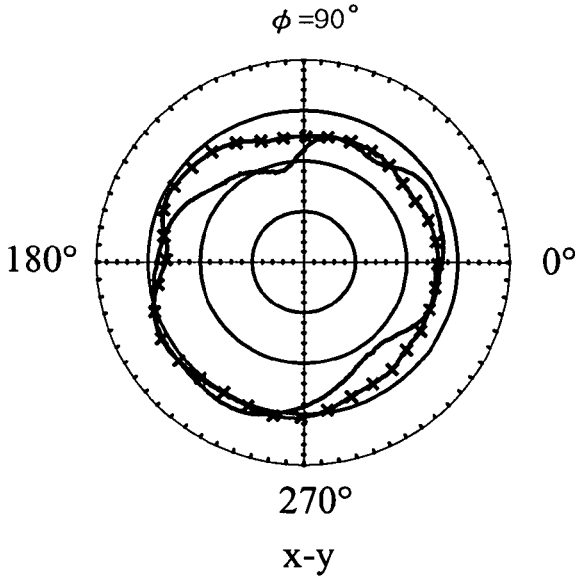
Figure 6A:
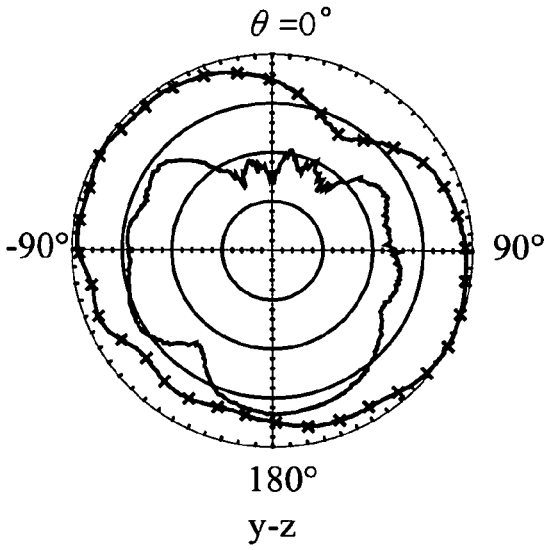
FIG. 6A~6C is a measured result of the radiation patterns at 5500 MHz.
Figure 6B:
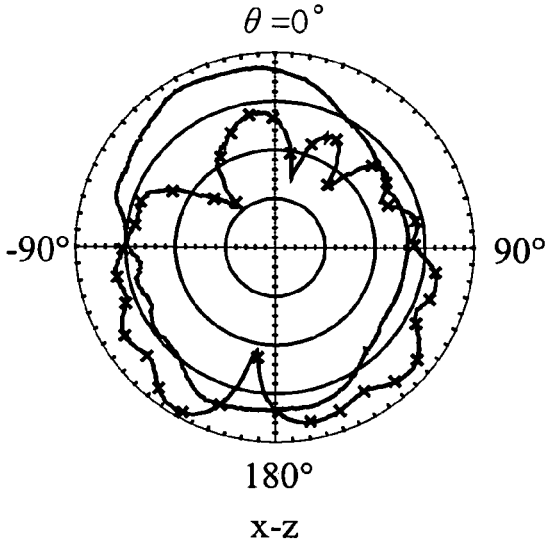
Figure 6C:
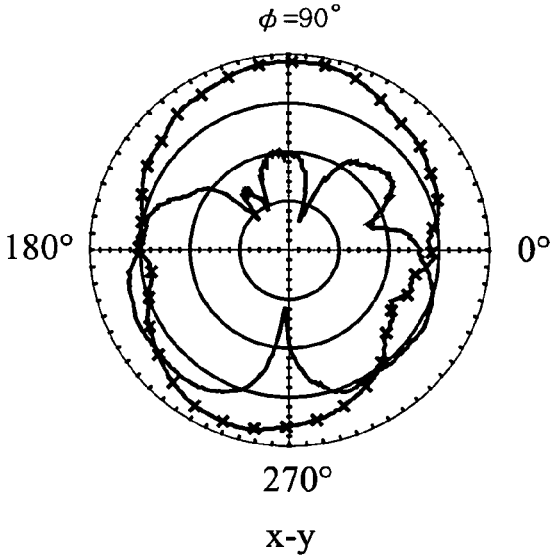

Refer to FIG. 3 for the measured return loss of the antenna according to the invention. The ground 11 has a length of about 118 mm and a width of about 60 mm. The radiating member 12 has a first sub-radiating member 121 with a bottom edge of about 60 mm and a height of about 7 mm from the bottom edge; a second sub-radiating member 122 with a length of about 10 mm and a width of about 60 mm; and a third sub-radiating member 123 with a length of about 7 mm and a width of about 60 mm. The via-hole 111 of the ground 11 is spaced from the closest edge of the ground 11 at a distance of about 3 mm.

As shown in FIG. 3, the experimental result shows that the impedance bandwidth of the antenna of the invention in a first (lower) operating band 21 can reach 1020 MHz (defined by 10 dB return loss); and the impedance bandwidth of the antenna in a second (higher) operating band 22 can reach 4200 MHz (defined by 10 dB return loss). Hence the operating band of the antenna of the invention can easily cover all bands required in mainstream mobile communication devices, such as 3G mobile communication (1920–2170 MHz) and wireless local area networks (2400–2484/5150–5350/5725–5875 MHz).

Refer to FIGS. 4A~4C, 5A~5C and 6A~6C for the measured radiation patterns of the antenna operating at 2045 MHz, 2442 MHz, and 5500 MHz. As shown in the drawings, when the antenna of the invention operates at various frequencies, the measured radiation patterns in the vertical planes (namely, x-z plane and y-z plane) and horizontal plane (namely, x-y plane) are desirable. Thus it can meet the requirements of 3G mobile communication and wireless local area networks.

Figure 7:
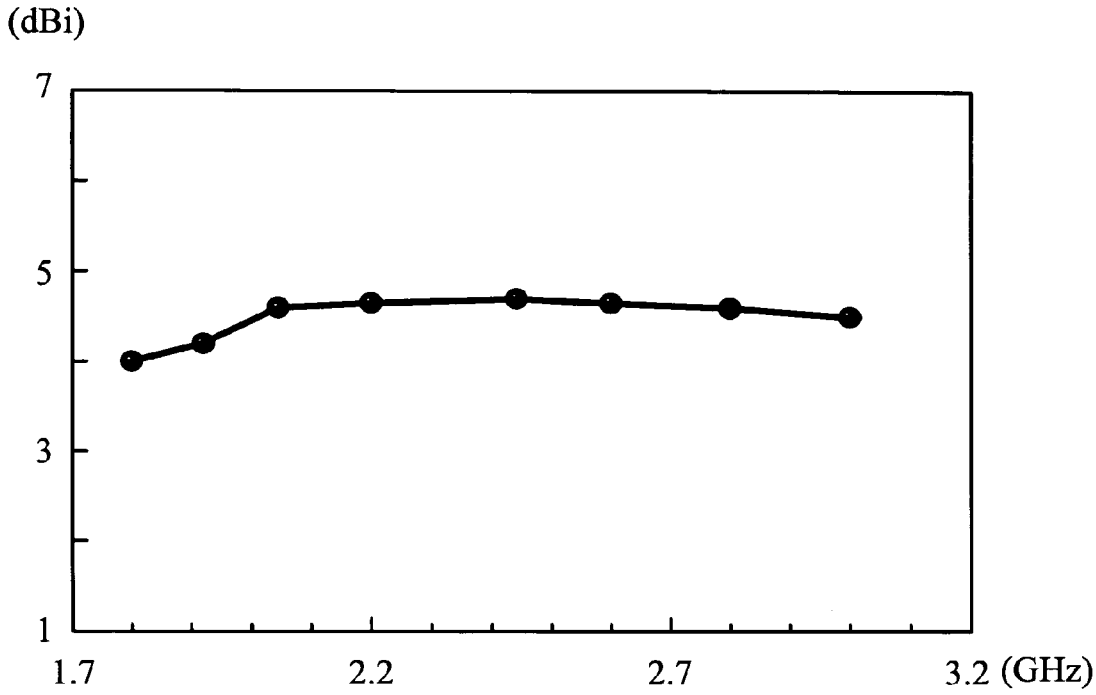
FIG. 7 is a measured result of the antenna gain in a first (lower) band.
Figure 8:
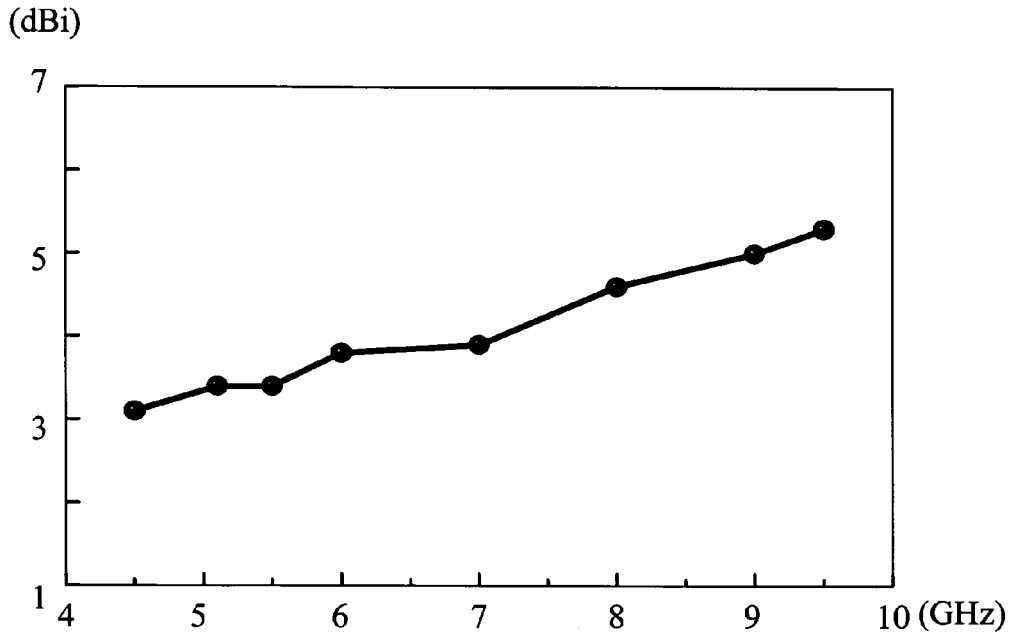
FIG. 8 is a measured result of the antenna gain in a second (higher) band.

Refer to FIGS. 7 and 8 for the measured antenna gain in a first (lower) band 21 and a second (higher) band 22. The experimental results show that the antenna gain is 4.0–4.7 dBi in the range of the first operating band 21, and 3.1–5.3 dBi in the range of the second operating band 22. It also can meet the antenna gain requirements of 3G mobile communication and wireless local area networks.

As seen in the experiment results based on the antenna of the invention previously discussed, the integrated antenna according to the invention can meet various band requirements of 3G mobile communication and wireless local area networks, and also can integrate other functional modules.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An integrated mobile communication antenna, comprising:

a ground having a via-hole;

a radiating member located above the ground having a feeding portion to electrically connect to a signal source through the via-hole to receive a signal, and having a housing opening; and a short-circuiting member having a space and a lower opening on a first end, said short-circuiting member being substantially vertical to the ground and electrically connected to the ground, and a second end of said short-circuiting member being electrically connected to the radiating member, and the second end of the short-circuiting member having an upper opening corresponding to the housing opening of the radiating member with the same size and shape so that a functional module can be fully exposed;

wherein the space houses a functional module which is integrated with the antenna.

2. The integrated mobile communication antenna of claim 1, wherein the ground is substantially rectangular.

3. The integrated mobile communication antenna of claim 1, wherein the radiating member further includes:

a first sub-radiating member formed substantially in triangular having a top point and a bottom edge opposing the top point, the feeding portion being located on the top point;

a second sub-radiating member substantially in parallel with the ground having a first edge and a second edge that oppose each other, the first edge being electrically connected to the bottom edge; and a third sub-radiating member substantially in parallel with the first sub-radiating member having a third edge electrically connected to the second edge.

4. The integrated mobile communication antenna of claim 3, wherein the first sub-radiating member, the second sub-radiating member and the third sub-radiating member are formed of a metal sheet by bending.

5. The integrated mobile communication antenna of claim 3, wherein the first sub-radiating member, the second sub-radiating member and the third sub-radiating member are formed of at least two independent metal sheets.

6. The integrated mobile communication antenna of claim 3, wherein the first sub-radiating member and the second sub-radiating member are electrically connected through an arched bending.

7. The integrated mobile communication antenna of claim 3, wherein the second sub-radiating member and the third sub-radiating member are electrically connected through an arched bending.

8. The integrated mobile communication antenna of claim 1, wherein the short-circuiting member has an upper opening on the second end connecting to the radiating member.

9. The integrated mobile communication antenna of claim 8, wherein the radiating member has an opening formed in a size and a shape mating the upper opening for connecting to the short-circuiting member.

10. The integrated mobile communication antenna of claim 1, wherein the short-circuiting member is formed in a shape selected from the group consisting of a circle, an ellipse, a rectangle and a polygon.

11. The integrated mobile communication antenna of claim 1, wherein the feeding portion further includes a feeding member which runs though the via-hole to receive the signal from the signal source.

12. The integrated mobile communication antenna of claim 1, wherein the lower opening and the upper opening of the short-circuiting member are the same size and shape.

* * * * *